US011937633B1

(12) United States Patent
Deng

(10) Patent No.: US 11,937,633 B1
(45) Date of Patent: Mar. 26, 2024

(54) VAPING MOUTHPIECE LOCKING STRUCTURE

(71) Applicant: Next Level Ventures LLC, Seattle, WA (US)

(72) Inventor: Yifeng Deng, Guangdong (CN)

(73) Assignee: Next Level Ventures LLC, Seattle, WA (US)

( * ) Notice: Subject to any disclaimer, the term of this patent is extended or adjusted under 35 U.S.C. 154(b) by 0 days.

(21) Appl. No.: 18/202,168

(22) Filed: May 25, 2023

(51) Int. Cl.
*A24F 40/40* (2020.01)
*A24F 40/70* (2020.01)

(52) U.S. Cl.
CPC ..... *A24F 40/40* (2020.01); *A24F 40/70* (2020.01)

(58) Field of Classification Search
CPC .... A24F 7/00; A24F 7/02; A24F 40/40; A24F 40/70
See application file for complete search history.

(56) References Cited

U.S. PATENT DOCUMENTS

| | | | |
|---|---|---|---|
| 3,024,947 | A | 3/1962 | Jeynes, Jr. |
| 6,095,376 | A | 8/2000 | Hennemann et al. |
| 6,186,141 | B1 | 2/2001 | Pike et al. |
| 7,708,014 | B2 | 5/2010 | Yamashita et al. |
| D782,729 | S | 3/2017 | Wright et al. |
| 9,999,254 | B2 | 6/2018 | Liu |
| 11,077,261 | B2 | 8/2021 | Liu |
| D930,237 | S | 9/2021 | Fornarelli |
| D930,896 | S | 9/2021 | Fornarelli |
| 2004/0216738 | A1 | 11/2004 | Edwards et al. |
| 2012/0318283 | A1 | 12/2012 | Watanabe et al. |
| 2013/0192615 | A1 | 8/2013 | Tucker et al. |

(Continued)

FOREIGN PATENT DOCUMENTS

| | | | |
|---|---|---|---|
| CN | 103892467 | B | 4/2016 |
| CN | 208259011 | U | 12/2018 |

(Continued)

OTHER PUBLICATIONS

USPTO acting as International Search Authority, "International Search Report and Written Opinion," for International Application No. PCT/US2022/046834, dated Jan. 31, 2023.

(Continued)

*Primary Examiner* — Hae Moon Hyeon
(74) *Attorney, Agent, or Firm* — Dentons Durham Jones Pinegar; Sarah W. Matthews; Lilly Godfrey

(57) ABSTRACT

This disclosure relates generally to vaporizing devices and components of vaporizing devices, such as mouthpiece locking structures. In various aspects, a locking structure for a mouthpiece includes a circular body extending between a proximal end and a distal end, where an interior surface of the body defines a central lumen. The locking structures may also include a clamp disposed within the central lumen, where the clamp has an angled wall extending inwardly from a rim of the interior surface of the body towards the central lumen. The clamp may additionally include a notch within the angled wall, with the angled wall of the clamp (i) encircling a substantial entirety of a circumference of the body, (ii) defining a clamp lumen, (iii) having a thickness ranging from about 0.5 mm to about 0.7 mm, and (iv) having an angle or bias of from about 100° to about 110°.

20 Claims, 11 Drawing Sheets

(56) References Cited

U.S. PATENT DOCUMENTS

| | | | | |
|---|---|---|---|---|
| 2014/0041655 | A1 | 2/2014 | Barron et al. | |
| 2015/0272218 | A1 | 10/2015 | Chen | |
| 2015/0296887 | A1 | 10/2015 | Zhu | |
| 2016/0100633 | A1 | 4/2016 | Gao | |
| 2016/0128387 | A1 | 5/2016 | Chen | |
| 2016/0270449 | A1 | 9/2016 | Hon | |
| 2016/0286865 | A1 | 10/2016 | King et al. | |
| 2016/0316820 | A1 | 11/2016 | Liu | |
| 2016/0353800 | A1 | 12/2016 | Di Carlo | |
| 2016/0366945 | A1 | 12/2016 | Rado | |
| 2017/0027228 | A1 | 2/2017 | Rastogi | |
| 2017/0071252 | A1 | 3/2017 | Liu | |
| 2018/0027879 | A1 | 2/2018 | Gavrielov et al. | |
| 2018/0103684 | A1* | 4/2018 | Liu | A24F 7/02 |
| 2019/0307974 | A1 | 10/2019 | Qiu | |
| 2021/0145064 | A1 | 5/2021 | Hejazi | |
| 2022/0175029 | A1* | 6/2022 | Michaud | A24F 40/42 |
| 2023/0011926 | A1 | 4/2023 | Hwang | |
| 2023/0116943 | A1* | 4/2023 | Deng | A24F 40/40 131/329 |
| 2023/0119264 | A1* | 4/2023 | Hwang | A24F 40/10 131/329 |
| 2023/0121357 | A1* | 4/2023 | Deng | H05B 3/42 131/329 |
| 2023/0210174 | A1* | 7/2023 | Xiujin | A24F 40/10 131/329 |

FOREIGN PATENT DOCUMENTS

| | | | |
|---|---|---|---|
| CN | 109315834 | A | 2/2019 |
| DE | 202004010700 | U1 | 9/2004 |
| DE | 202005019043 | U1 | 2/2006 |
| EP | 3135331 | A1 | 3/2017 |
| GB | 2534986 | A | 8/2016 |
| WO | 1998004307 | A1 | 2/1998 |
| WO | 2016145656 | A1 | 9/2016 |
| WO | 2017045132 | A1 | 3/2017 |
| WO | 2023064896 | A1 | 4/2023 |

OTHER PUBLICATIONS

USPTO acting as International Searching Authority, "International Search Report and Written Opinion," for International Application No. PCT/US2022/046454, dated Feb. 22, 2023.

* cited by examiner

VAPING MOUTHPIECE LOCKING STRUCTURE

TECHNICAL FIELD

This disclosure relates generally to vaporizing devices and components of vaporizing devices, such as mouthpiece locking structures.

BACKGROUND

Presently, some vaporizing devices (also referred to herein as "vaping devices") utilize a locking structure or locking sleeve to attach a mouthpiece to a cartridge of the vaping device. One example of a locking sleeve is described in U.S. Pat. No. 9,999,254, entitled "E-CIGARETTE AND E-CIGARETTE ATOMIZER AND MOUTHPIECE THEREOF," (referred to here in as the "'254 patent"). In the '254 patent, the locking sleeve includes two or more clamp spring bars, which are teeth-like projections extending from a base of the looking sleeve. The locking sleeve is fixed inside the mouthpiece, and the clamp spring bars are intended to secure the mouthpiece to an air guide tube, or center post, and the cartridge (an open e-liquid chamber).

However, the locking sleeve of the '254 patent and similar locking sleeves have many drawbacks. First, the structure of the locking sleeve, and particularly the clamp springs bars or teeth-like projections, causes an uneven pressure distribution when capping the mouthpiece over the air guide tube and/or the cartridge. This uneven pressure distribution can cause the position of the air guide tube within the cartridge to shift, which causes oil stored within the cartridge to leak out of the vaping device. This is undesirable for many reasons, such as a loss in oil to be vaporized, meaning a user has to replace the cartridges more frequently.

Additionally, the leakage of oil is unsightly and dirty. The oils contained within the cartridge are typically sticky and tacky, meaning they are difficult to remove from surfaces such as tables or clothing. The oil can also stain the fabrics it comes into contact with. As vaping devices are generally carried in pockets or purses, staining of the fabric is undesirable.

Second, the design of the clamp spring bars requires an intricately formed mold to manufacture the locking sleeve. Molds generally degrade over time with use, but the more intricate a mold, the greater the rate of degradation. Specifically, the small intricate details are more likely to get lost or smoothed out over time, meaning the produced locking sleeves and clamp spring bars also lose their intricate definition. This means the same mold no longer produces a detailed locking sleeve, but rather produces locking sleeves with greater defect rates.

For example, the locking sleeve of the '254 patent has many curved and chamfered edges. The clamp spring bars also have chamfered edges and have hooked portions that are meant to engage the air guide tube. If the clamp spring bars are not formed with their required degree of detail (lengths, hooks, chamfered edges, etc.), the locking sleeve will not adequately and securely attach the mouthpiece to either the air guide tube or the cartridge. This can also cause leakage of oil from the vaping device.

Third, if even one of the clamp springs bars breaks or is not formed with the required level of detail, the entire locking sleeve will inadequately attach the mouthpiece to the air guide tube and/or the cartridge. This is because the clamp spring bars will be unable to fully engage the air guide tube. Additionally, the loss of even one clamp spring bar will exacerbate the uneven pressure distribution when the mouthpiece and locking sleeve are placed over the air guide tube and/or the cartridge.

SUMMARY

Disclosed are systems, devices, and/or methods of use thereof regarding vaporizing devices and components of vaporizing devices, such as mouthpiece locking structures. In various aspects, a locking structure includes a circular body extending between a proximal end and a distal end, where an interior surface of the body defines a central lumen. The locking structures may also include a clamp disposed within the central lumen, where the clamp has an angled wall extending inwardly from a rim of the interior surface of the body towards the central lumen. The clamp may additionally include a notch within the angled wall, with the angled wall of the clamp (i) encircling a substantial entirety of a circumference of the body, (ii) defining a clamp lumen, (iii) having a thickness ranging from about 0.5 mm to about 0.65 mm, and (iv) having an angle or bias of from about 100° to about 110°. The notch may have a width of about 1.5 mm to about 2.2 mm, and the locking structure may be for capping a center post of the vaporizing device and for interfacing with the mouthpiece of the vaporizing device. In some embodiments, a pressure to cap the center post with the locking structure ranges from 7 kg/cm$^2$ to 10 kg/cm$^2$.

In some embodiments, a locking structure for the mouthpiece of a vaporizing device includes a circular body having an interior surface, an exterior surface, and extending between a proximal end and a distal end, where the body includes a base portion, a top portion, and a lumen defined by and extending between the base portion and the top portion. The locking structure also includes a clamp disposed within the top portion of the body, with the clamp extending inwardly from a rim of the interior surface of the body towards the lumen and extending circumferentially around the interior surface of the body. In some embodiments, a proximal edge of the clamp has a width of about 0.5 mm and defines a notch having a width of about 1.5 mm to about 2.2 mm. The clamp may extend at an angle or bias of about 100° to about 110°. In some embodiments, the locking structure is for capping a center post of the vaporizing device and for receiving the mouthpiece of the vaporizing device, where a tension to separate the capped center post from the locking structure ranges from 7 kg to 35 kg and the locking structure receives the mouthpiece through a one-way press-fit connection.

In some embodiments, a locking structure for a mouthpiece of a vaporizing device includes a circular body defining a body lumen for receiving a center post and an exterior surface of the circular body for interfacing and receiving the mouthpiece. The locking structure may also include a clamp disposed within the body lumen, the clamp comprising a single projection extending inwardly for interfacing with a proximal end of the center post of the vaporizing device. In some embodiments, the single projection defines a notch allowing the projection to flex over the center post to be one-way press fit. A diameter of the clamp lumen may be smaller than a diameter of the body lumen, and the notch may have a width ranging from about 1.5 mm to 2.5 mm. The angled wall may have a thickness of about 0.6 to 0.75 mm.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Vaping devices may be used for portable vaping. A vaping device may vaporize an oil or liquid pre-vapor formulation, such as an oil that may (or may not) contain one or more cannabinoids, to form a vapor. The vaping device may include a reservoir that holds a pre-vapor formulation and a heating element that vaporizes the pre-vapor formulation by applying heat to at least a portion of the pre-vapor formulation. Vaping devices are often sold and shipped directly to local oil manufacturers, filled with a pre-vapor formulation, and then capped by the local oil manufacturers.

Filling and capping may be done by hand or it may be automated. For automated filling and capping, a mouthpiece must be able to be effectively and securely attached to the reservoir by a machine. The mouthpiece and associated structures must plug the reservoir to ensure that no pre-vapor formulation can spill out of the reservoir.

There is a need for an improved vaping device to simply, securely, and reliably lock the mouthpiece onto the cartridge.

Figure 1:
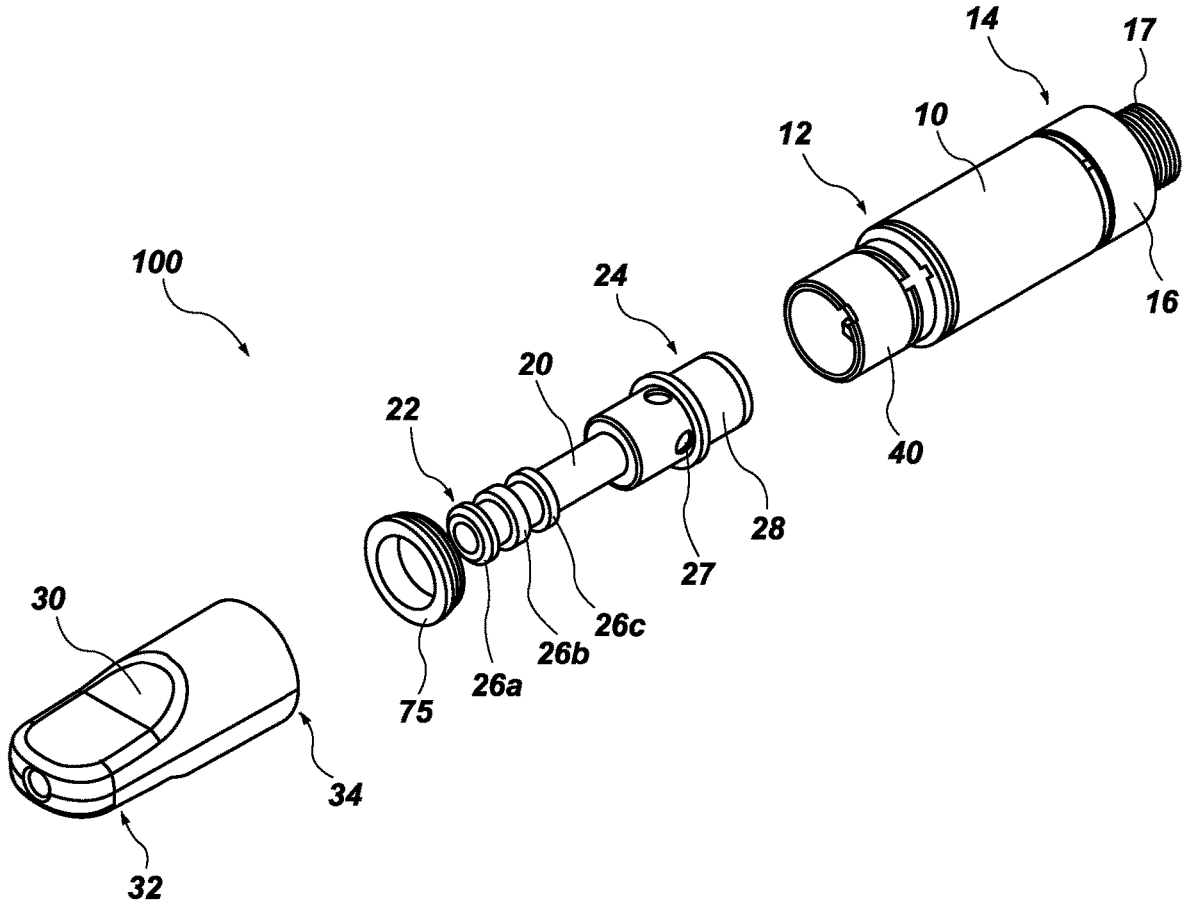
FIG. 1 illustrates an exploded perspective view of a vaping system.

FIG. 1 illustrates an exploded view of a vaping system 100 according to the present disclosure. As illustrated, the vaping system 100 generally includes a cartridge tank or body 10 having an interior reservoir to be filled with oil or another liquid (i.e., a pre-vapor formulation, reservoir not illustrated) for vaping. The vaping system 100 also includes a cartridge base 16 for attachment to a distal end 14 of the cartridge tank 10, a mouthpiece 30, and a locking structure 40 for connecting the cartridge tank 10 to the mouthpiece 30. The mouthpiece 30 can be attached to a proximal end 12 of the tank 10, thereby sealing the tank 10. In some embodiments, the base 16 may include a means for connection to a battery to provide power to the heating element (shown, by way of example, as threaded distal projection 17 in FIG. 1).

The vaping system 100 also includes a center post 20 having a proximal end 22 and a distal end 24. The center post 20 defines an interior lumen (not illustrated) extending between the proximal end 22 and the distal end 24. In some embodiments, the distal end 24 includes an atomizer housing 28 that receives or otherwise contains an atomizer or heating element for heating the oil to create vapor. Various gaskets 75 (only one gasket 75 is illustrated) may be employed to seal various components of the vaping system 100 when the vaping system 100 is fully assembled.

In some embodiments, the distal end 24 of the center post 20 defines or includes one or more holes 27 for allowing oil from the reservoir of the tank 10 to enter the atomizer housing 28, contact one or more heating elements housed by the atomizer housing 28, and be heated into vapor. As the oil is vaporized, it travels upward through the interior lumen of the center post 20; from the distal end 24 of the center post 20 to the proximal end 22 of the center post 20 to the mouthpiece 30 to be inhaled by the user. The vaping system 100 may include one or more gaskets or seals 75 between the mouthpiece 30 and the tank 10 to ensure the oil or other pre-vapor formulation does not leak out the mouthpiece 30.

The center post 20 includes one or more ridges 26 at or near the proximal end 22. As illustrated, the center post 20 includes three ridges: first ridge or proximal ridge 26*a* for interfacing with a locking structure 40, as described in more detail below, a second ridge 26*b* and a third ridge 26*c*. The space formed between the second and third ridges 26*b*, 26*c* may receive a gasket. Instead of three ridges, one ridge, two ridges, or four or more ridges may be provided. Gaskets may be placed between ridges or the space between the ridges may be left as open space.

Figure 2A:
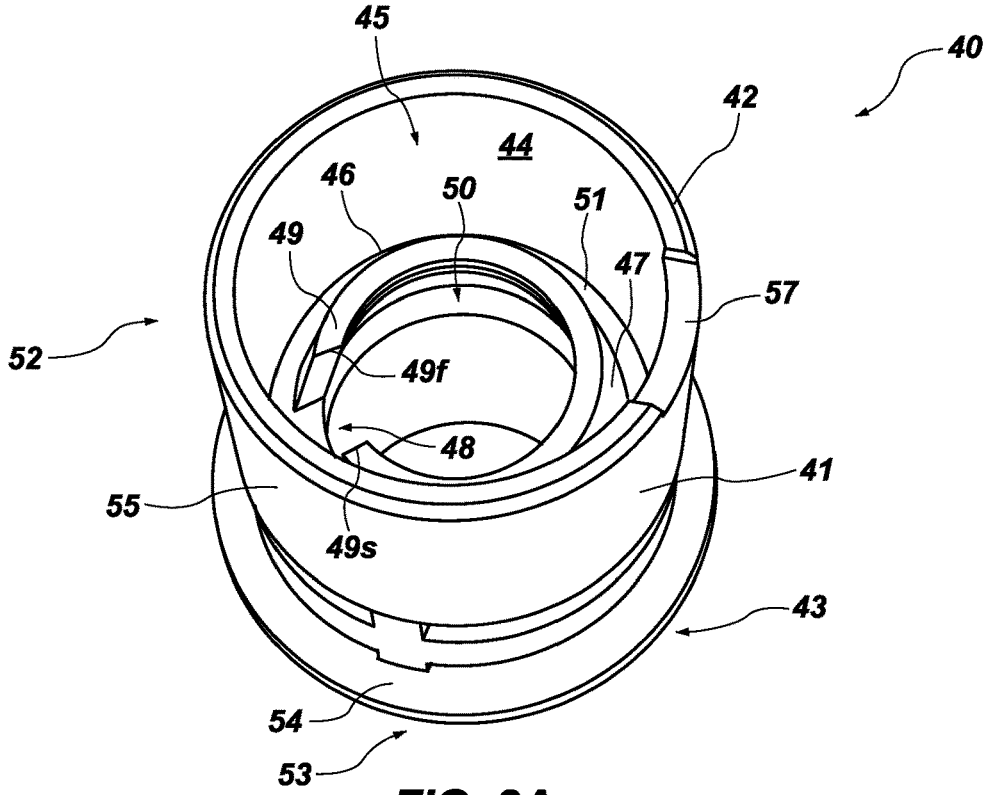
FIGS. 2A and 2B illustrate top perspective views of a mouthpiece locking structure according to the present disclosure.
Figure 2B:
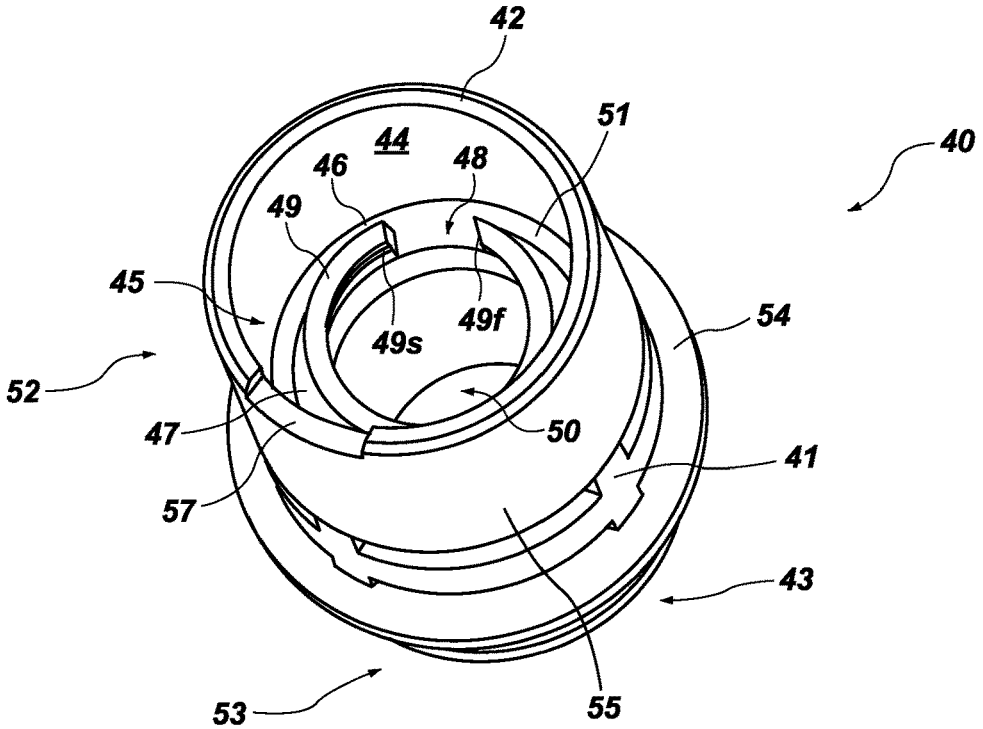

FIGS. 2A and 2B illustrate top perspective views of a locking structure 40 for a mouthpiece according to the present disclosure. As illustrated, the locking structure 40 includes a body 41 having a proximal end 42, a top portion 52, a distal end 43, a bottom portion 53, an inner surface 44, and an exterior surface 55. An indent 57 may be formed or defined in the proximal end 42, where the indent 57 may facilitate (i) manufacturing (e.g., injection molding) of the locking structure 40 and/or (ii) removal of the locking structure 40 from a mold. The body 41 may include a medial flange 54 disposed between, or substantially between, the top portion 52 and the bottom portion 53. The medial flange 54 may receive a gasket (see gasket 75 of FIG. 1) or other component to facilitate sealing of the vaping system 100. Additionally, and/or alternatively, the medial flange 54 may interface with or abut a distal end 34 of the mouthpiece 30 when the locking structure 40 is received by the mouthpiece 30. The mouthpiece 30 may also include a proximal end 32 opposite the distal end 34. The body 41 and/or the interior surface 44 may define a central lumen 45 that extends from the proximal end 42 to the distal end 43.

Disposed within the central lumen 45 and/or the top portion 52 is a clamp 46. In some embodiments, the clamp 46 includes a wall 47 that extends inwardly toward the central lumen 45 from a rim 51 of the interior surface 44. The wall 47 may extend from the rim 51 to a proximal edge 49. The wall 47 may extend circumferentially about the rim 51 and/or the interior surface 44 of the body 41. The wall 47 may extend from the rim 51 toward the central lumen 45 at an angle; that is, the wall 47 may be angled or have a bias. In some embodiments, the angle or bias of the wall 47 ranges from about 100° to about 110°, such as 101°, 102°, 103°, 104°, 104.5°, 105°, 108°, or an angle within a range defined by any two of the foregoing values. For example, referring briefly to FIG. 10, the rim 51 of the interior surface 44 may be considered 0° and the wall 47 extends at an angle from the rim 51. The wall 47 may have a height ranging from about 0.9 mm to 2 mm, such as 1 mm, 1.5 mm, 1.8 mm, 1.9 mm, 1.95 mm, or a height within a range defined by any two of the foregoing values. That is, the wall 47 may extend proximally into the central lumen by about 0.9 mm to 2 mm. The wall 47 may also have a thickness which can range from about 0.5 mm to about 0.65 mm, such as 0.55, 0.6, 06 mm or a thickness within a range defined by any two of the foregoing values.

The clamp 46 can also include a notch 48, or a void, unfilled space, gap, or otherwise a break in continuity of the clamp 46. The notch 48 may be defined by the wall 47. In some embodiments, the notch 48 is defined by the wall 47 and the rim 51, such that the notch 48 "extends" from the rim 51 to the proximal edge 49 of the wall 47. In other embodiments, the notch 48 does not extend from the rim 51 to the proximal edge 49 of the wall 47, but rather extends only from the proximal edge 49 part-way to the rim 51. The proximal edge 49 of the wall 47 may have a length extending from a first end 49*f* to a second 49*s*, where the notch 48 is disposed within a space between the first end 49*f* and the second end 49*s*. The proximal edge 49 and/or the wall 47 may be continuous (i.e., without interruption or breaks) except for the notch 48. With the notch 48 in the clamp 46, the clamp 46 may be considered generally C-shaped.

Figure 10:
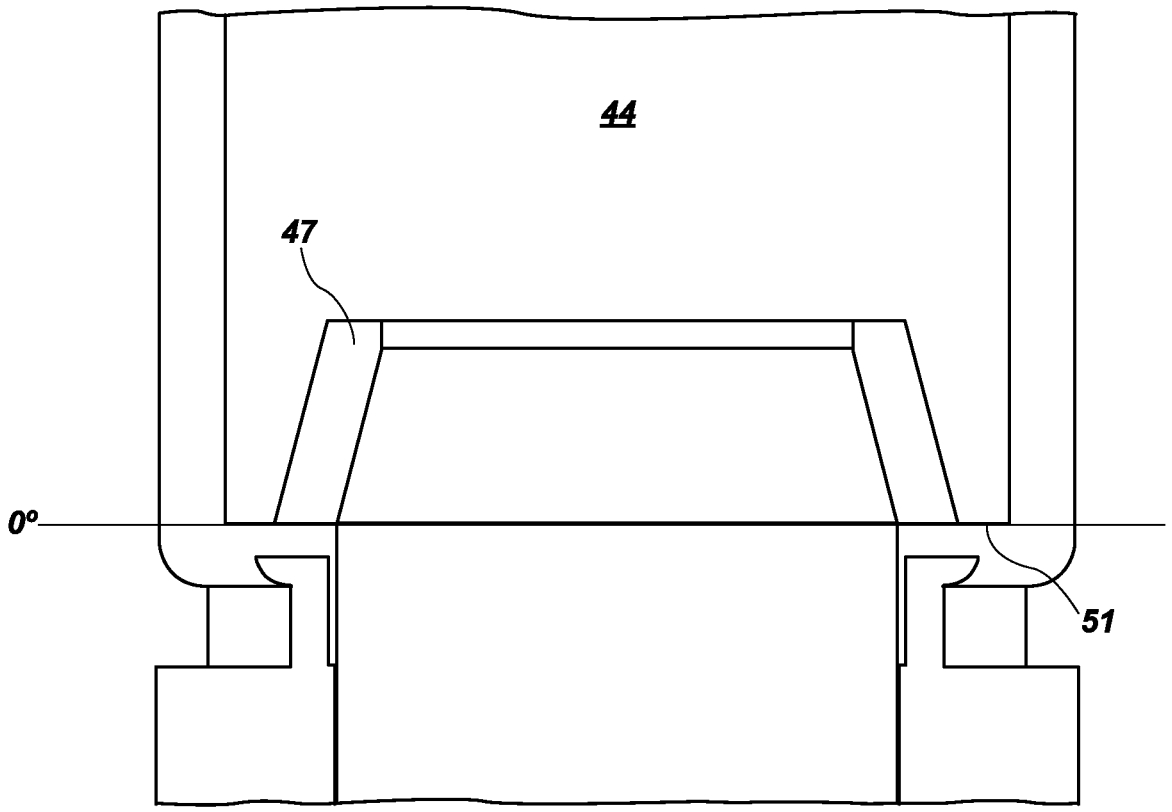
FIG. 10 illustrates various dimensions and angles, in millimeters (mm) and degrees (°) respectively, for a mouthpiece locking structure according to the present disclosure.

In some embodiments, a width of the notch 48 ranges from 1.5 mm to 2.2 mm, such as 1.7, 1.9, 2 mm or a width within a range defined by any two of the foregoing values. In some embodiments, the width of the notch 48 is 2 mm. FIG. 10 illustrates various dimensions and angles of the clamp 46 and the locking structure 40. In other embodiments, the width of the notch 48 ranges from about 1 mm to about 6 mm.

Figure 3A:
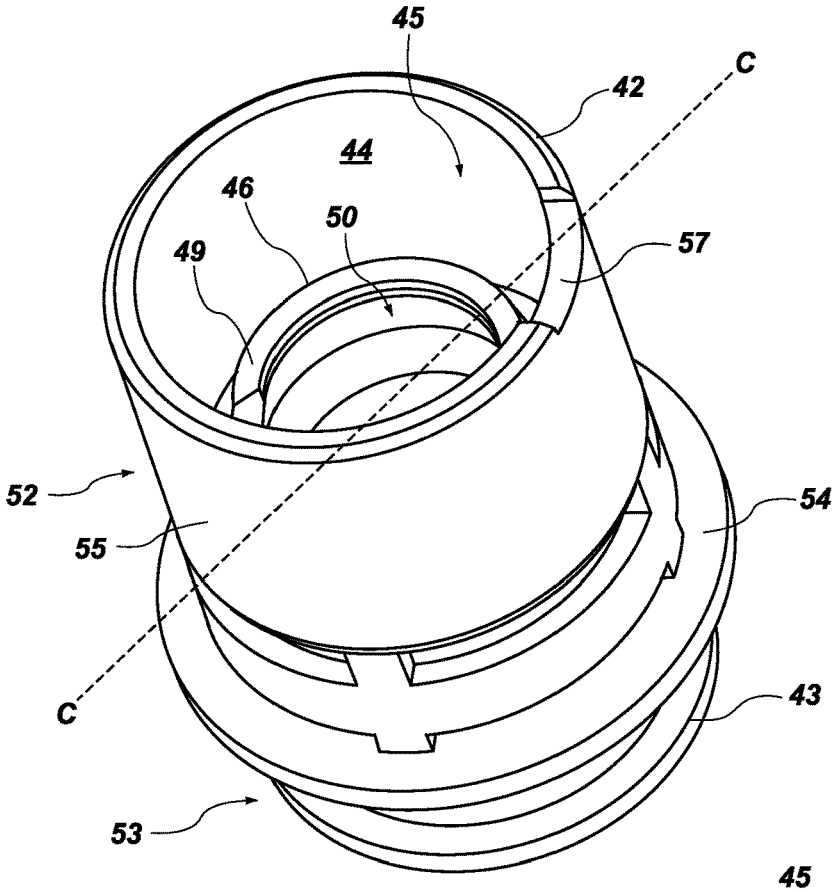
FIG. 3A illustrates a top perspective view of the locking structure of FIGS. 2A-2B and FIG. 3B is a cross-sectional view of FIG. 3A taken along the line C-C.
Figure 3B:
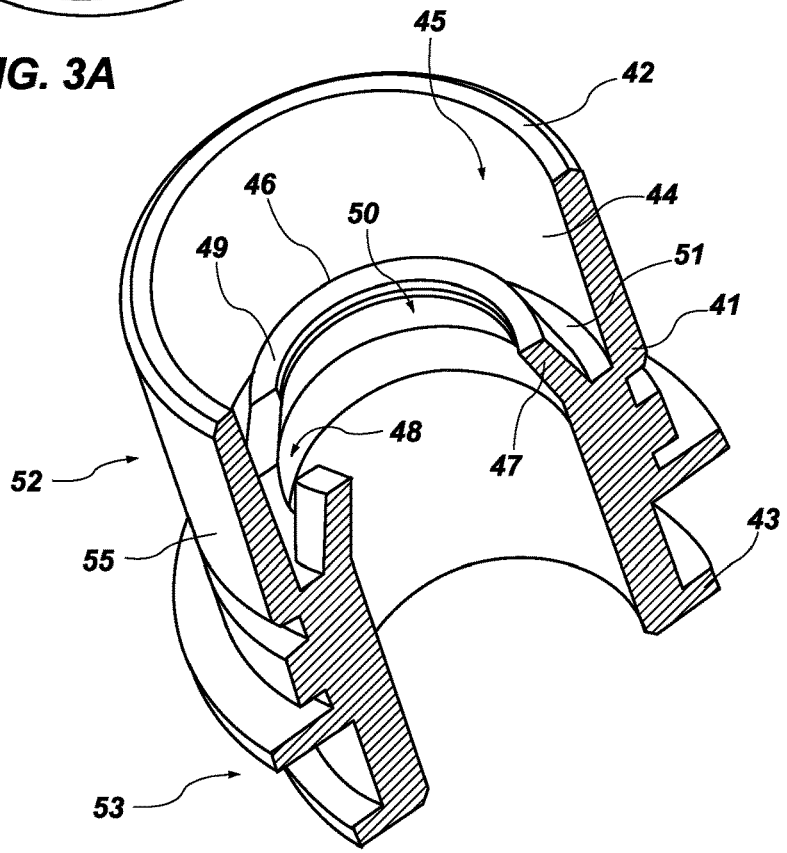

FIG. 3A illustrates a top side perspective view of the locking structure 40 of FIGS. 2A-2B and FIG. 3B is a cross-sectional view of FIG. 3A taken along the line C-C of FIG. 3A. As before, the locking structure 40 has a body 41 with a proximal end 42, a top portion 52, a distal end 43, and a bottom portion 53. Between the top and bottom portions 52, 53 is a medial flange 54. In some embodiments, the medial flange 54 abuts or interfaces with a distal end 34 of the mouthpiece 30 (see FIG. 1). In some embodiments, a gasket may be disposed between the mouthpiece 30 and the exterior surface 55 of the locking structure 40 to thereby fit the mouthpiece 30 to the locking structure 40.

Disposed within the top portion 52 is a clamp 46. The top and bottom portions 52, 53 together define a central lumen 45. In some embodiments, the interior surface 44 of the body 41 defines the central lumen 45. The clamp 46 includes a wall 47, which may have a degree of angle or bias, and a notch 48 defined by and/or within the wall 47. The wall 47 may extend inwardly from an inner rim 51 towards the central lumen 45. That is, the wall 47 may extend proximally from the rim 51 towards the central lumen 45 and may terminate at a proximal edge 49. In some embodiments, the wall 47 extends proximally by about 1 mm. The proximal edge 49 may have a width of about 0.5 to about 0.7 mm. As discussed more fully below, the proximal edge 49 may engage or otherwise interface with a proximal lip or flange of a center post of a vaping system 100 (see center post 20 of the vaping system 100 of FIG. 1).

As can clearly be seen in FIG. 3B, the clamp 46 extends circumferentially within the body 41 and about the rim 51. The wall 47 may be continuous, or substantially continuous, except for the notch 48. Similarly, the proximal edge 49 of the wall 47 may be continuous, or substantially continuous, except for the notch 48. As such, the wall 47 and/or the proximal edge 49 may engage the center post 20 continuously or substantially continuously, except for the notch 48. The notch 48 may be defined by the rim 51, the wall 47, and the proximal edge 49. The wall 47 and/or the proximal edge 49 also define a clamp lumen which may be aligned within the central lumen 45. The clamp lumen 50 is sized and shaped to receive a proximal portion of the center post, such as center post 20 in FIG. 1.

Figure 4A:
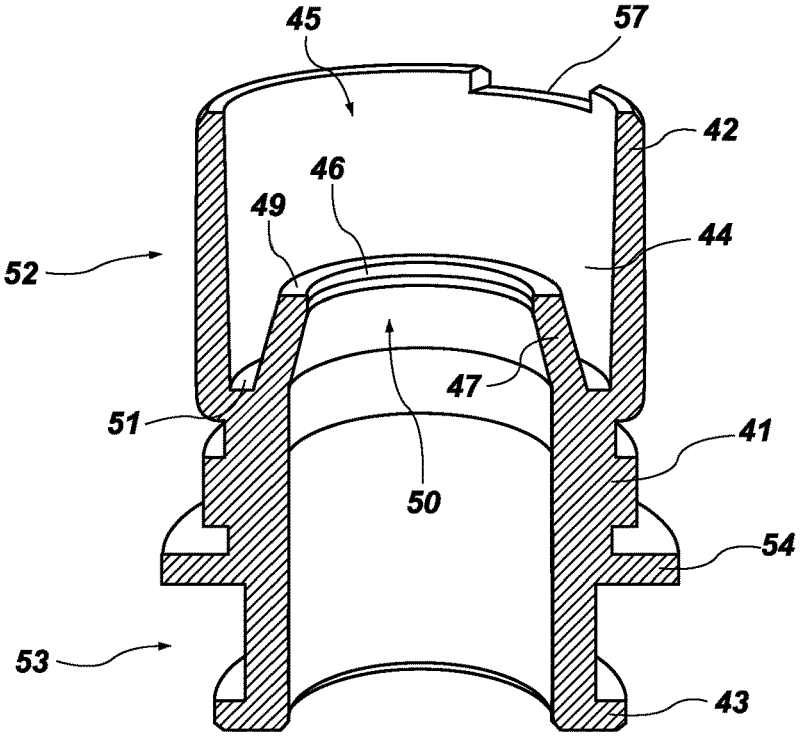
FIGS. 4A and 4B illustrate cross-sectional views of the locking structure of FIGS. 2A-2B.
Figure 4B:
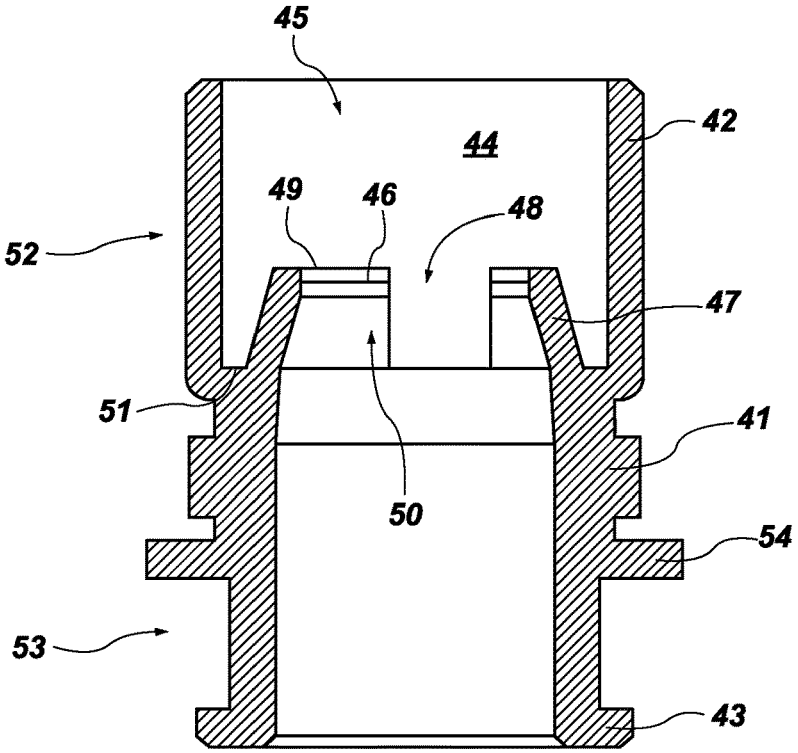
Figure 4C:
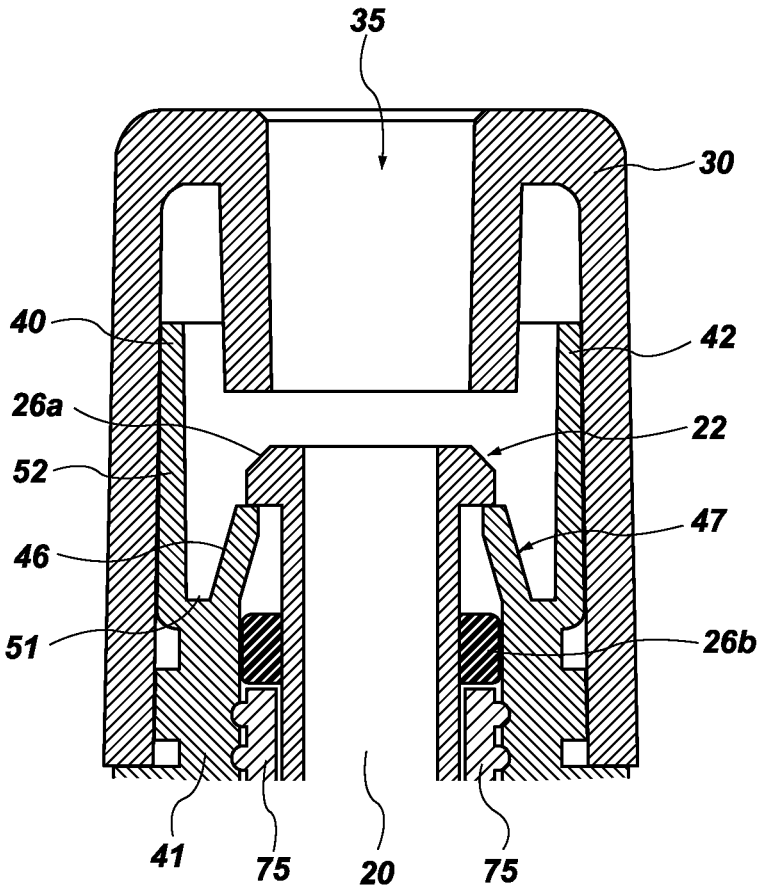
FIG. 4C illustrates a cross-sectional view of the locking structure of FIGS. 4A-4B having received a mouthpiece and a center post of a vaporizing device.

FIGS. 4A and 4B illustrate cross-sectional views of the locking structure of FIGS. 2A-2B. FIG. 4C illustrates a cross-sectional view of the locking structure of FIGS. 4A-4B having received a mouthpiece 30 and a center post 20 of a vaping system 100. Referring to FIGS. 4A-4C together, the locking structure 40 includes the body 41 and the clamp 46. As before, the body 41 has proximal and distal ends 42, 43, and top and bottom portions 52, 53. An indent 57 may be defined or formed within the proximal end 42. The clamp 46 can be disposed within or substantially within the top portion 52. The bottom portion 53 may be for interfacing with a cartridge or tank, such as cartridge 10 in FIG. 1.

As clearly seen in FIG. 4C, the clamp 46 interfaces and surrounds a proximal end 22 of the center post 20. Specifically, the clamp 46 engages the proximal ridge 26*a* of the center post 20. Even more specifically, the proximal edge 49 of the clamp 46 engages the proximal ridge 26*a*. In some embodiments, one or more gaskets 75 may be disposed between the center post 20 and the body 41 of the locking structure 40 to facilitate a sealed connection between the center post 20 and the locking structure 40.

The top portion 52 of the body 41 may interface and/or receive the mouthpiece 30. The mouthpiece 30 may define a mouthpiece lumen 35 through which vapor produced by an atomizer (not illustrated) may travel to be inhaled by a user. The mouthpiece lumen 35 may align and/or be in fluid communication with the central lumen 45. The clamp lumen 50 (not illustrated) surrounds and receives the center post 20.

Though not visible in FIG. 4C, the clamp 46 includes the notch 48. The notch 48 allows the clamp 46 to have a degree of flex as the clamp 46 engages the center post 20. Specifically, the locking structure 40 is pressed over the proximal end 22 of the center post 20 to thereby receive the center post 20. As the locking structure 40 is pressed over the proximal end 22 of the center post, the clamp 46 must flex outwardly because the circumference of the proximal ridge 26*a* of the center post is greater than the circumference of the clamp 46. The notch 48 allows the clamp 46 to flex outwardly as it is pressed over the proximal end 22 of the center post, and then return back to its shape after it passes over the proximal ridge 26*a*.

Surprisingly, less pressure is required to press the locking structure 40 over the center post 20 than would be expected given the substantially continuous nature of the clamp 46. Specifically, clamps 46 that have teeth or a plurality of spaces disposed within the clamp 46 are typically thought to require less pressure to engage center posts 20 than continuous structures. That is, the teeth of these clamps have more flex individually, and also the overall surface area of these teeth that must be pressed outwardly over the proximal ridge 26*a* is less than the surface area of the clamp 46 that must be pressed outwardly over the proximal ridge 26*a*. This is surprising because the wall 47 and/or the proximal edge 49 of the clamp 46 are substantially continuous, meaning more pressure would typically be required to press the locking structure 40 over the center post 20. The presence of the notch 48 allows the clamp 46 to flex around the center post 20 and employ smaller pressures to fully engage the center post 20. Clamps with a plurality of teeth typically require a total amount of pressure to engage the center post from 7 kg/cm$^2$ to 10 kg/cm$^2$, with an average pressure of 8.63 kg/cm$^2$. Surprisingly, the clamp 46 of the present disclosure engages the center post 20 with a pressure ranging from 7 kg/cm$^2$ to 10 kg/cm$^2$, with an average pressure of 8.54 kg/cm$^2$, which is the same or less than clamps having teeth.

Table 1 shows data taken to compare the amount of pressure required to cap a prior art locking structure with four teeth onto a central lumen of a vaping device, and the amount of pressure required to cap a locking structure of the present disclosure onto a central lumen of a vaping device. The amount of force was increased in 0.1 kg/cm$^2$ increments until the locking structure was capped onto the central lumen.

TABLE 1

Mouthpiece locking structure capping pressure test

| Standard prior art with 4 separate teeth (Average = 8.63 kg) | Present disclosure (Average = 8.54 kg) |
|---|---|
| 9.6 kg | 9.5 kg |
| 9 kg | 8 kg |
| 9 kg | 8 kg |
| 8.9 kg | 8 kg |
| 9 kg | 8 kg |
| 7.5 kg | 8.5 kg |
| 8 kg | 9.3 kg |
| 8.5 kg | 7.8 kg |
| 9 kg | 8.8 kg |
| 9.5 kg | 9.5 kg |
| 8.5 kg | 8 kg |
| 8 kg | 8.7 kg |
| 8.5 kg | 9.3 kg |
| 8.5 kg | 7.5 kg |
| 8 kg | 8.3 kg |
| 8.5 kg | 9.5 kg |

Another surprising result is that a tension required to pull the center post 20 out of the locking structure 40 and the clamp 46 is very high. For example, a tension to release the center post 20 from the clamp 46 may range from about 10 kg to about 35 kg of tension, such as about 15, 20, 25, 30 kg of tension, or a tension within a range defined by any two of the foregoing values. A high tension is desirable, because the mouthpiece is designed to be non-removable by pulling off with tension (for quality control purposes, child resistant purposes, etc.).

Clamps that have two or more teeth are more prone to failure because if even one tooth breaks or fails, the entire clamp is incapable of adequately engaging the center post. This means that the entire vaping system (e.g., vaping system 100) is rendered useless. Additionally, if the teeth are not perfectly formed with all their edges, the teeth will not adequately engage the center post and the vaping system 100 may leak or provide insufficient hits to a user (e.g., little vapor is produced and/or delivered, etc.).

Also surprisingly, the clamp 46 of the present disclosure promotes an even distribution of pressure while pressing or capping the clamp 46 around and over the center post 20. An even distribution of pressure ensures a position of the center post 20 within a cartridge 10 does not change during the capping process. Changing the position of the center post 20 within the cartridge 10 may cause leaks of the oil out of the cartridge 10 or may cause insufficient heating of the oil by the atomizer. An even distribution of pressure also ensures that the mouthpiece 30 is not misaligned with the center post 20 (e.g., the mouthpiece lumen 35 and the internal lumen of the center post) during the capping process. Misalignment of the mouthpiece 30 and the center post 20 can cause a user to receive a dry or insufficient hit. In prior art devices with a plurality of teeth, misalignment and a less even distribution of pressure is seen compared to the present disclosure with a single "tooth" or clamp 46.

Figure 5A:
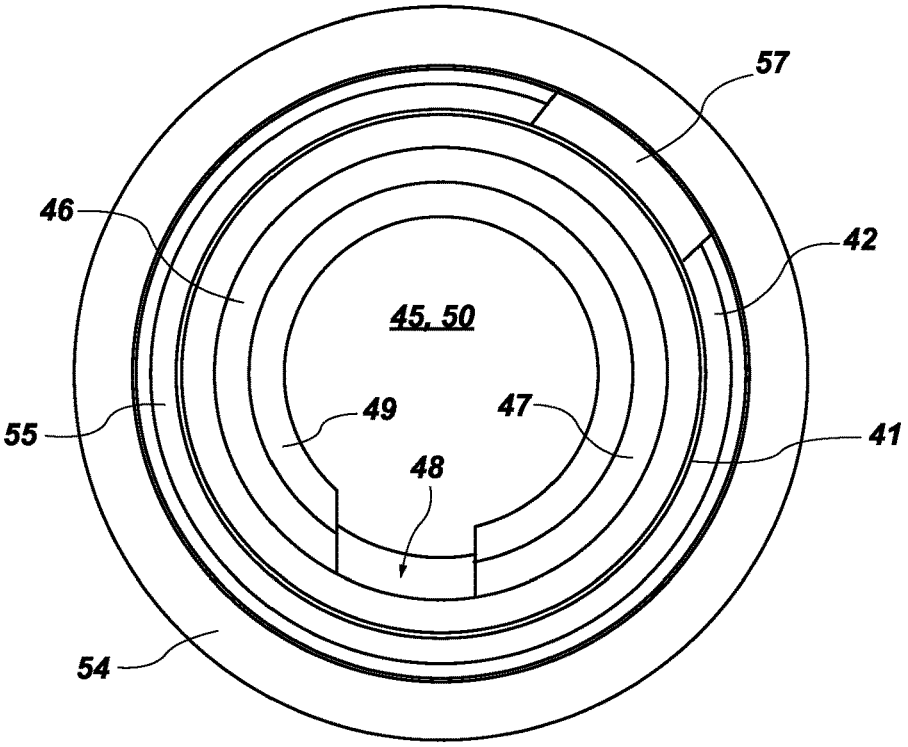
FIG. 5A illustrates a top view and FIG. 5B illustrates a bottom view of the locking structure of FIGS. 2A-2B.
Figure 5B:
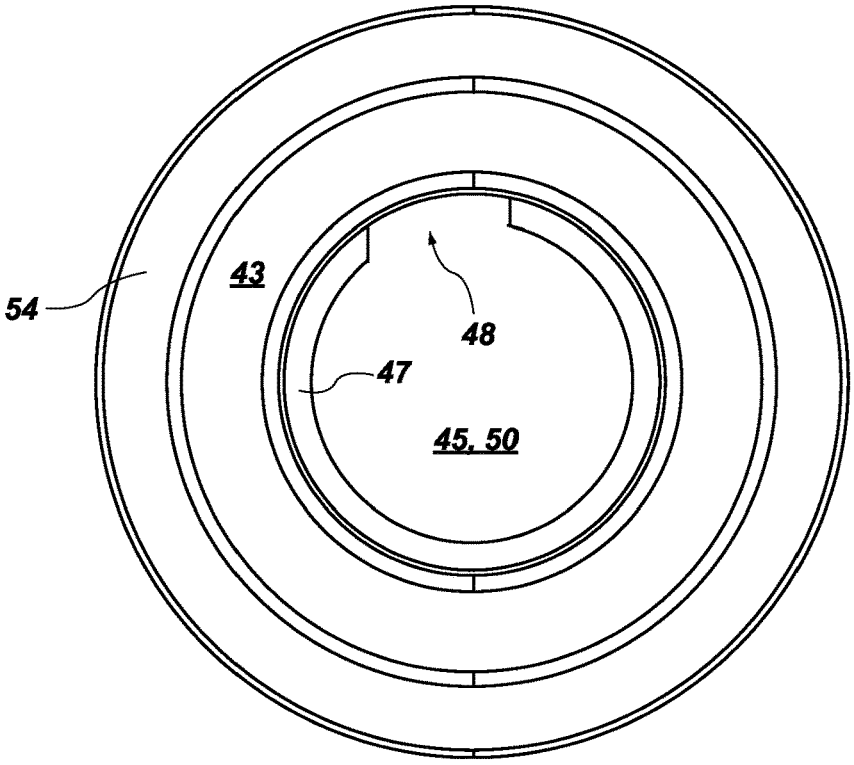

FIG. 5A illustrates a top view and FIG. 5B illustrates a bottom view of the locking structure of FIGS. 2A-2B. In both FIGS. 5A and 5B, the notch 48 of the clamp is clearly visible. The medial flange 54 is disposed circumferentially about the exterior surface 55 of the body 41. The clamp lumen 50 is aligned and disposed within the central lumen 45.

Figure 6A:
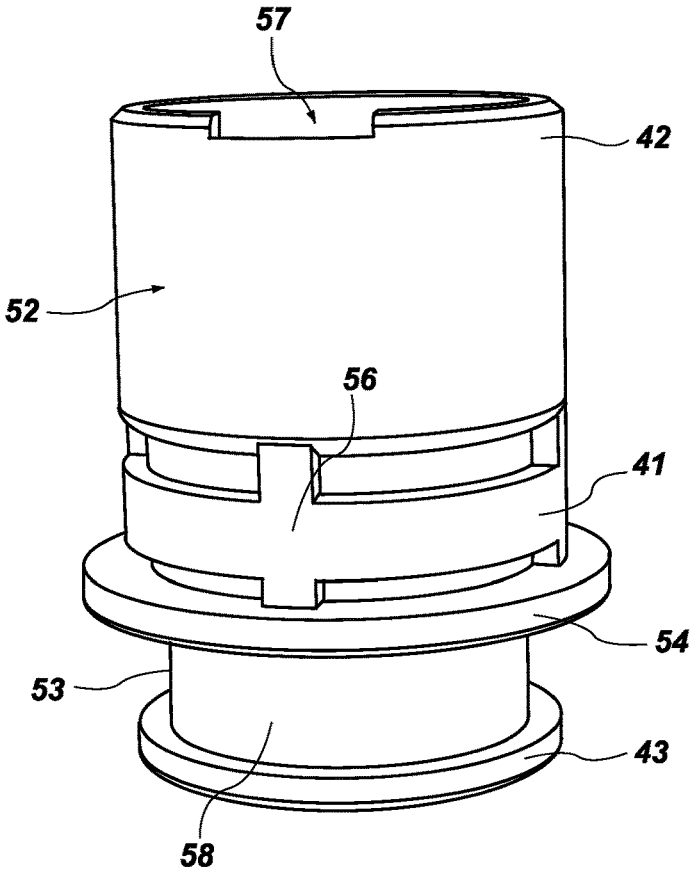
FIGS. 6A and 6B illustrate side view of the locking structure of FIGS. 2A-2B.
Figure 6B:
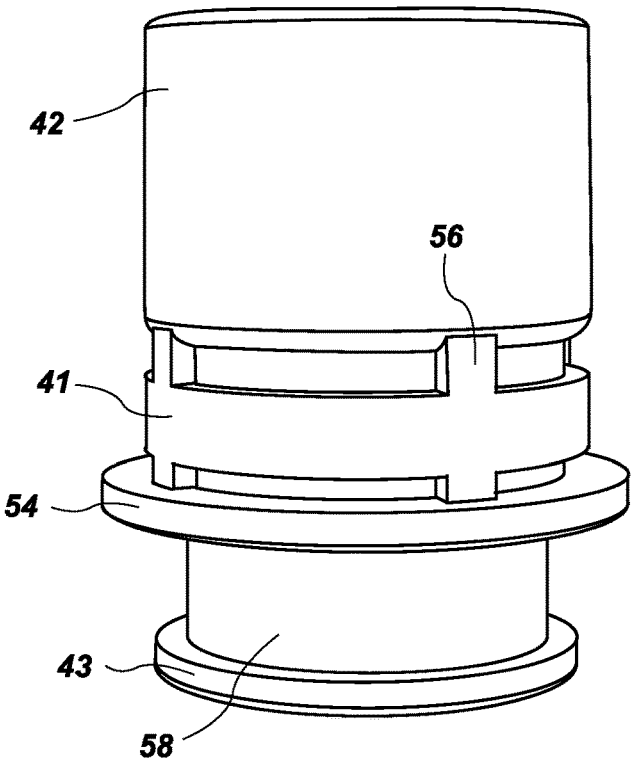

FIGS. 6A and 6B illustrate side view of the locking structure 40 of FIGS. 2A-2B. As before, the body 41 of the locking structure 40 has an exterior surface 55. In some embodiments, such as illustrated in FIGS. 6A-6B, the exterior surface 55 defines or includes one or more ribs 56. The ribs 56 may increase engagement between the mouthpiece 30 and the locking structure 40, and/or may provide a one-way press-fit connection between the mouthpiece 30 and the locking structure 40. The exterior surface 55 also defines or includes a cavity 58 within the bottom portion 53. The cavity 58 may be for receiving a gasket 75 to attach the locking structure 40 to the cartridge 10. Such connection may be a one-way press-fit connection and may be a sealed connection, such that no oil or liquid leaks out of the cartridge 10 and/or the vaping system 100.

Figure 7A:
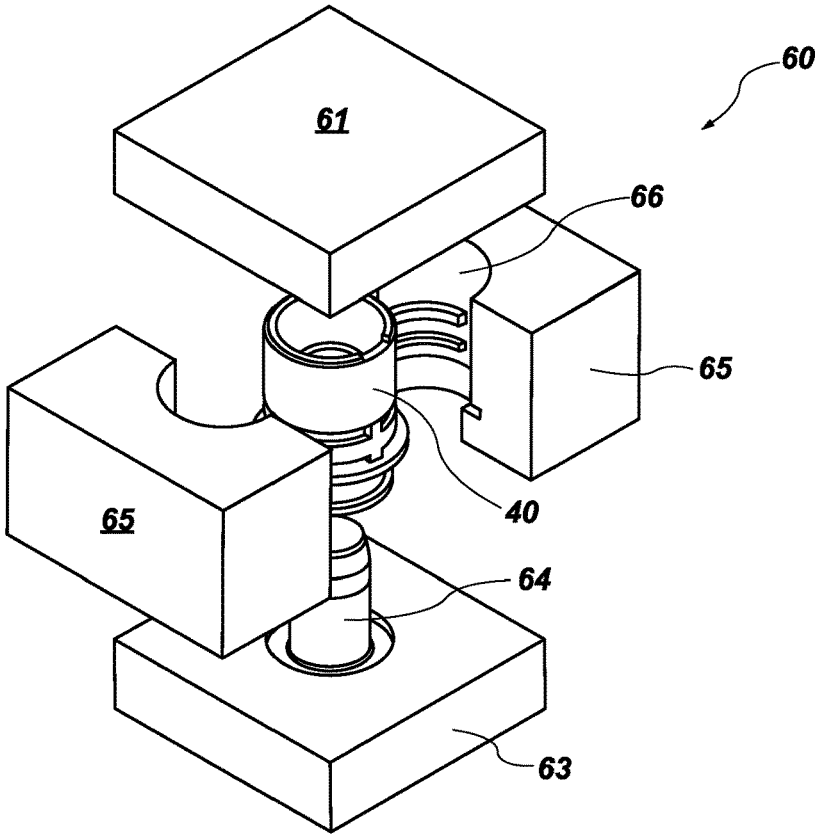
FIGS. 7A to 7C illustrate perspective views of a mold for forming the locking structure of FIGS. 2A-2B and the locking structure formed from the mold.
Figure 7B:
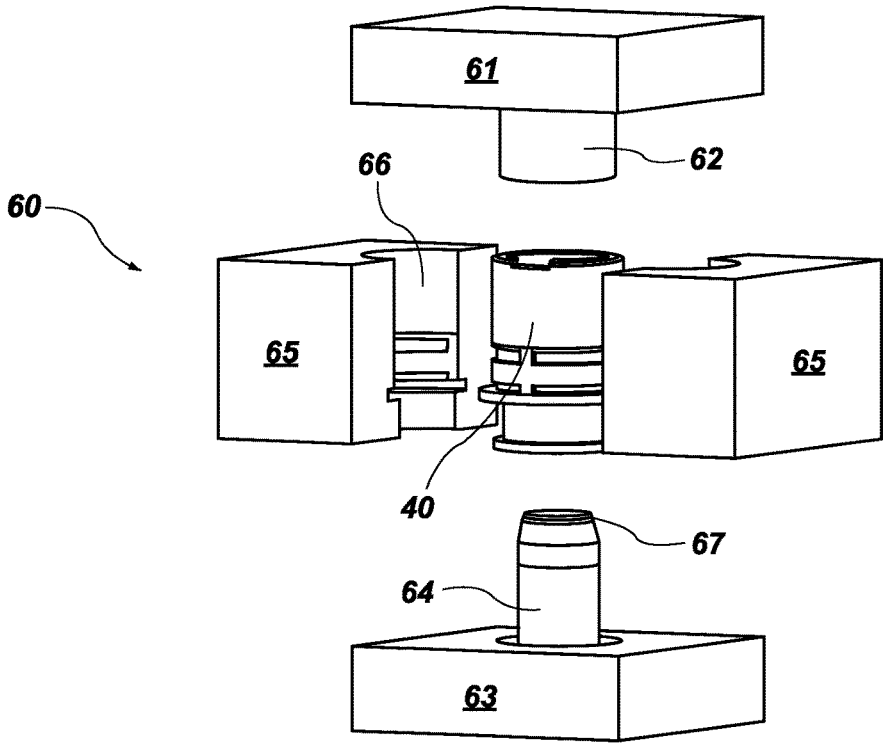
Figure 7C:
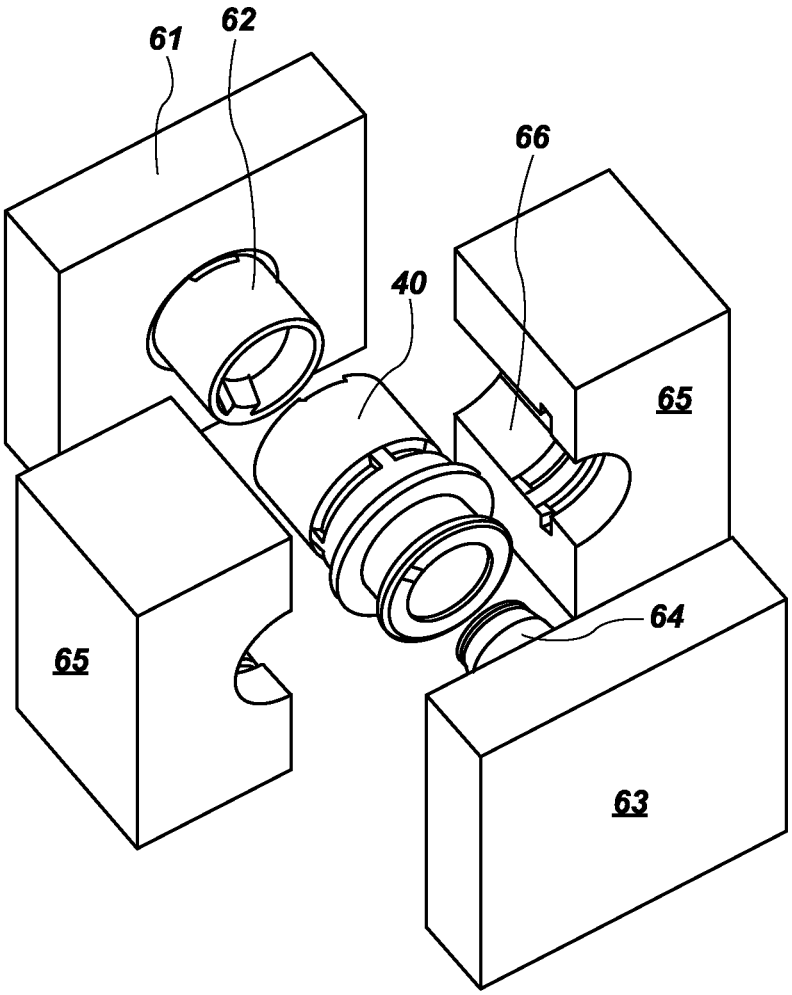

FIGS. 7A to 7C illustrate perspective views of a mold 60 for forming the locking structure 40 of FIGS. 2A-2B and the locking structure 40 formed from the mold 60. In some embodiments, such as illustrated, the mold 60 includes a top 61 with a top projection 62, a bottom 63 with a bottom projection 64, and sides 65 each having a cavity 66. The top projection 62 may have features that correspond to the central lumen 45, the interior surface 44, and the indent 57 at the proximal end 42 of the body 41 of the locking structure 40. The bottom projection 64 may have features corresponding to the clamp 46, the wall 47, the notch 48, the proximal edge 49, and the clamp lumen 50. The cavities 66 of the sides 65 may have features corresponding to the exterior surface 55, the one or more ribs 56, the medial flange 54, and the cavity 58 of the body 41.

The mold 60 may be used in an injection molding process. In some embodiments, the top projection 62 receives or mates with the bottom projection 64 and a space is formed between the top and bottom projections 62, 64. The sides 65 may receive or surround the mated top and bottom projections 62, 64 such that a space is formed between the sides 65 and the mated top and bottom projections 62, 64. The material used to form the locking structure 40 may be injected into the mold and may fill (i) the space between the top and bottom projections 62, 64 and (ii) the space between the sides 65 and the mated top and bottom projections 62, 64. In this way, the material will be molded into the locking structure 40. The material may be injected and then cooled, after which the mold 60 may be disassembled (e.g., the individual pieces may be removed) to free the formed locking structure 40 from the mold 60.

Due to the unitary, or substantially unitary, nature of the locking structure 40 and the clamp 46, the mold 60 is greatly simplified compared to locking structures containing clamps with teeth. The mold 60 is simplified in that there are fewer chamfered edges necessary to form the locking structure 40 and/or the clamp 46. The mold 60 also includes fewer minute or fine details, which details are prone to degradation over time. Thus, the mold 60 may have a longer useful lifespan compared to molds including fine details (e.g., teeth, chamfered edges, intricate structures, etc.). As one specific example, a mold that includes teeth or other projections has more parts that can degrade and fail over time, such as by losing their definition.

Figure 8:
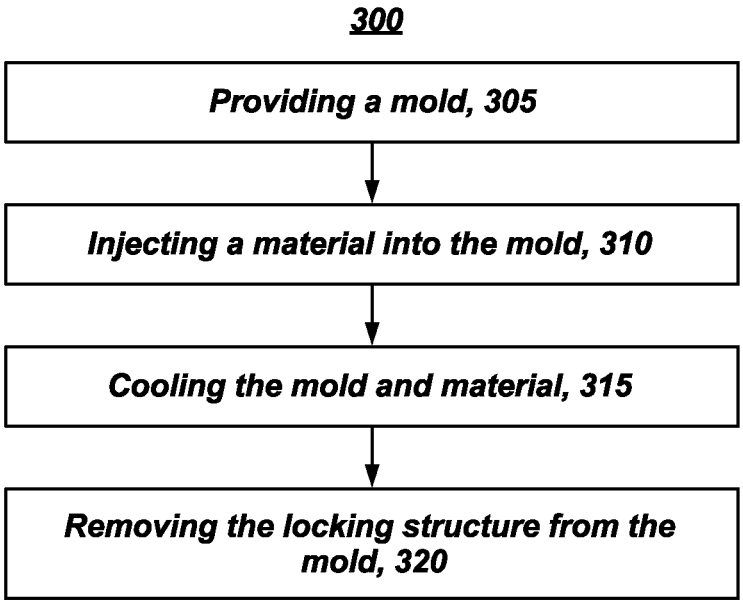
FIGS. 8-9 illustrate flowcharts of example methods for molding or forming a locking structure according to the present disclosure.
Figure 9:
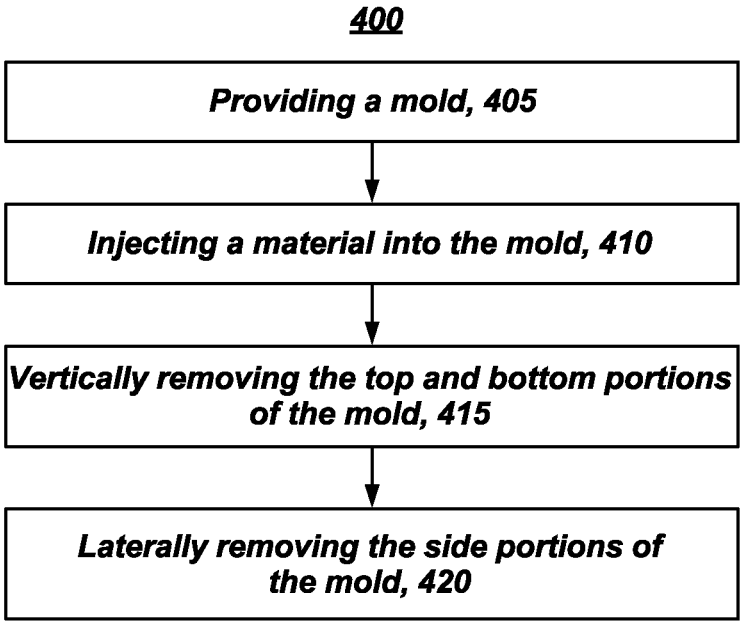

FIGS. 8-9 illustrate flowcharts of example methods of forming or molding a locking structure for a mouthpiece of a vaporizing device. One example method 300 may include providing a mold, at 305. The mold may be mold 60 of FIGS. 7A-7C for forming the locking structure 40 of FIGS. 2A-6B. The method 300 may also include injecting a material into the mold, at 310, and cooling the mold and the material, at 315. In some embodiments, the locking structure may be formed of plastic, acrylic, thermoplastics, metal, metal alloys, any combinations thereof, or any suitable material for injection molding processes. The method 300 may include removing the locking structure from the mold, at 320.

Another example method 400 may include providing a mold, at 405, and injecting a material into the mold, at 410. As before, the mold may be mold 60 of FIGS. 7A-7C for forming the locking structure 40 of FIGS. 2A-6B. Also as before, the material injected may be a plastic, acrylic, thermoplastic, metal, metal alloy, any combinations thereof, or any suitable material for injection molding processes. The method 400 may also include vertically removing the top and bottom portions of the mold, at 415. The method 400 may further include laterally removing the side portions of the mold, at 420.

The locking structure of the present disclosure is designed for enhanced stability and secure attachment of the mouthpiece to the vaping device. According to one embodiment, the circular body is essentially cylindrical, defining an interior or body lumen that is designed to receive at least a portion of the center post of the vaping device. The exterior surface of the circular body is configured for a precise and tight interface with the mouthpiece of the vaping device.

The c-shaped clamp is disposed within the body lumen and extends inwardly at an angle, making direct contact with the proximal end of the center post of the vaporizing device. The clamp is manufactured from a flexible yet resilient material, allowing it to be outwardly flexible to adapt to varying diameters of the center post while maintaining a secure grip. This clamp provides a one-way press-fit over the center post, thereby creating a secure connection that prevents accidental detachment of the mouthpiece. As the clamp is placed over the center post, it is able to flex outwardly, and then once it is over the end of the center post, the clamp returns to its original position and grips the center post. However, when needed, in some configurations, the mouthpiece can be intentionally detached by applying a sufficient force, without causing damage to the vaping device or the mouthpiece.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A locking structure for a mouthpiece of a vaporizing device, the locking structure comprising:

a circular body extending between a proximal end and a distal end, an interior surface of the body defining a central lumen; and a clamp disposed within the central lumen, the clamp comprising an angled wall extending inwardly from a rim of the interior surface of the body towards the central lumen and a notch within the angled wall, the angled wall of the clamp defining a clamp lumen and having an angle or bias of from about 100° to about 110°, the notch having a width of about 1.5 mm to about 2.2 mm, and the locking structure for interfacing with a center post of the vaporizing device and for interfacing with the mouthpiece of the vaporizing device.

2. The locking structure of claim 1, wherein a proximal edge of the angled wall has a width ranging from 0.4 to 0.6 mm, such as 0.45, 0.5, 0.55, 0.58 mm or a width within a range defined by any two of the foregoing values.

3. The locking structure of claim 2, wherein the proximal edge of the angled wall interfaces with a proximal ridge of the center post.

4. The locking structure of claim 1, wherein the width of the notch is 2 mm.

5. The locking structure of claim 1, wherein the angled wall is continuous except for the notch.

6. The locking structure of claim 1, wherein the angled wall has a height of 1 to 2.5 mm, such as 1.3, 1.5, 1.8, 1.9, 2, 2.3 mm or a height within a range defined by any two of the foregoing values.

7. The locking structure of claim 1, wherein the clamp lumen has a diameter of about 4 to 5 mm.

8. A locking structure for a mouthpiece of a vaporizing device, the locking structure comprising:

a circular body having an interior surface, an exterior surface, and extending between a proximal end and a distal end, the body comprising a bottom portion, a top portion, and a central lumen defined by and extending between the bottom portion and the top portion; and a clamp disposed within the top portion of the body, the clamp extending inwardly from a rim of the interior surface of the body towards the central lumen and extending circumferentially around the interior surface of the body, a proximal edge of the clamp defining a notch to allow the clamp to flex outwardly; and the locking structure for engaging a center post of the vaporizing device and for engaging the mouthpiece of the vaporizing device.

9. The locking structure of claim 8, wherein the exterior surface of the body defines a cavity for receiving a seal.

10. The locking structure of claim 8, wherein the proximal edge of the clamp interfaces with a proximal ridge of the center post.

11. The locking structure of claim 8, wherein the width of the notch is 2 mm.

12. The locking structure of claim 8, wherein the clamp is continuous except for the notch.

13. The locking structure of claim 8, wherein the clamp has a height of about 1.5 to 2 mm.

14. The locking structure of claim 8, wherein the clamp defines a clamp lumen having a diameter of about 4 to 5 mm.

15. A locking structure for a mouthpiece of a vaping device, the vaping device having a center post, and the locking structure comprising:

a circular body defining a central lumen for receiving a portion of the center post and an exterior surface of the circular body for interfacing with the mouthpiece;

a generally C-shaped clamp disposed within the central lumen, the clamp extending inwardly for interfacing with a proximal end of the center post of the vaping device, and wherein the clamp is outwardly flexible to be press fit over the center post.

16. The locking structure of claim 15, wherein, a proximal edge of the clamp has a length extending from a first end to a second end, and the length of the proximal edge of the clamp engages a proximal end of the center post.

17. The locking structure of claim 16, wherein a notch is formed between the first end and the second end.

18. The locking structure of claim 15, wherein a pressure to press-fit the center post to the locking structure ranges from 7 $kg/cm^2$ to 10 $kg/cm^2$.

19. The locking structure of claim 15, wherein a proximal edge of the clamp has a width of 0.49 mm to 0.6 mm.

20. The locking structure of claim 16, wherein the proximal edge of the clamp engages the proximal end of the center post of the vaping device.

* * * * *